US006580880B1

(12) United States Patent
Regelsberger et al.

(10) Patent No.: US 6,580,880 B1
(45) Date of Patent: Jun. 17, 2003

(54) ELECTROPHOTOGRAPHIC PROCESS CONTROL AND DIAGNOSTIC SYSTEM

(75) Inventors: Matthias Regelsberger, Rochester, NY (US); David E. Hockey, Brockport, NY (US); Edward M. Eck, Lima, NY (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/572,526

(22) Filed: May 17, 2000

(51) Int. Cl.[7] ..... G03G 15/00
(52) U.S. Cl. ..... 399/31; 399/11; 399/50
(58) Field of Search ..... 399/50, 9, 31, 399/32, 46, 48, 11

(56) References Cited

U.S. PATENT DOCUMENTS 5,012,279 A * 4/1991 Nakajima et al. ..... 399/31
5,523,831 A * 6/1996 Rushing ..... 399/31
5,862,433 A * 1/1999 Regelsberger et al. ..... 399/44
5,897,238 A 4/1999 Hockey et al.
5,937,229 A 8/1999 Walgrove et al.
6,055,399 A 4/2000 Omura

FOREIGN PATENT DOCUMENTS

JP 8-185016 * 7/1996

* cited by examiner

*Primary Examiner*—Joan Pendegrass

(57) ABSTRACT

A logic and control unit (LCU) is configured to assess the viability of various subsystems in the electrophotographic marking process. The LCU determines a charging efficiency between a primary charger and a photoconductor, establishes a reference voltage on the photoconductor, wherein the reference voltage corresponds to the charging efficiency, operates a first subsystem in a non-print production mode to produce a first resulting voltage on the photoconductor, and translates the photoconductor to a stationary sensor for measuring the first resulting voltage.

17 Claims, 3 Drawing Sheets

ELECTROPHOTOGRAPHIC PROCESS CONTROL AND DIAGNOSTIC SYSTEM

FIELD OF THE INVENTION

The present invention relates to electrophotographic marking machines, and more particularly, to the testing of subsystems of the electrophotographic process and to provide for specific subsystem adjustment procedures in relation to predetermined parameters.

BACKGROUND OF THE INVENTION

The electrophotographic marking process is relatively complicated and employs a plurality of subsystems, each of which must be properly functioning. However, as these subprocesses are inter-related, it is often hard to diagnose and isolate the function of a particular subsystem. This is particularly critical for electrophotographic image formation and image development processes as visual inspection under ambient light is typically impractical.

Therefore, the need exists for the analysis and diagnostic testing of an electrophotographic process wherein specific subsystems may be compared to acceptable operating parameters and appropriate remedial actions taken.

SUMMARY OF THE INVENTION

The present invention provides the selective control of an electrophotographic marking machine to allow the functional testing of subsystems. In a further configuration, the invention provides for each subsystem functional test to be self-executing and thus compliment subsystem specific diagnostic and checkout programs.

Thus, the present invention provides for the creation of a reference voltage on a photo conductive member such as a belt, wherein the belt is rotated in a non-print mode to be exposed to a predetermined subsystem and the resulting voltage is measured and compared to predetermined acceptable limits. Subsequently, a recovery cycle is implemented to place the electrophotographic marking machine in a print mode.

DETAILED DESCRIPTION OF THE PREFERRED EMBODIMENT

Figure 1:
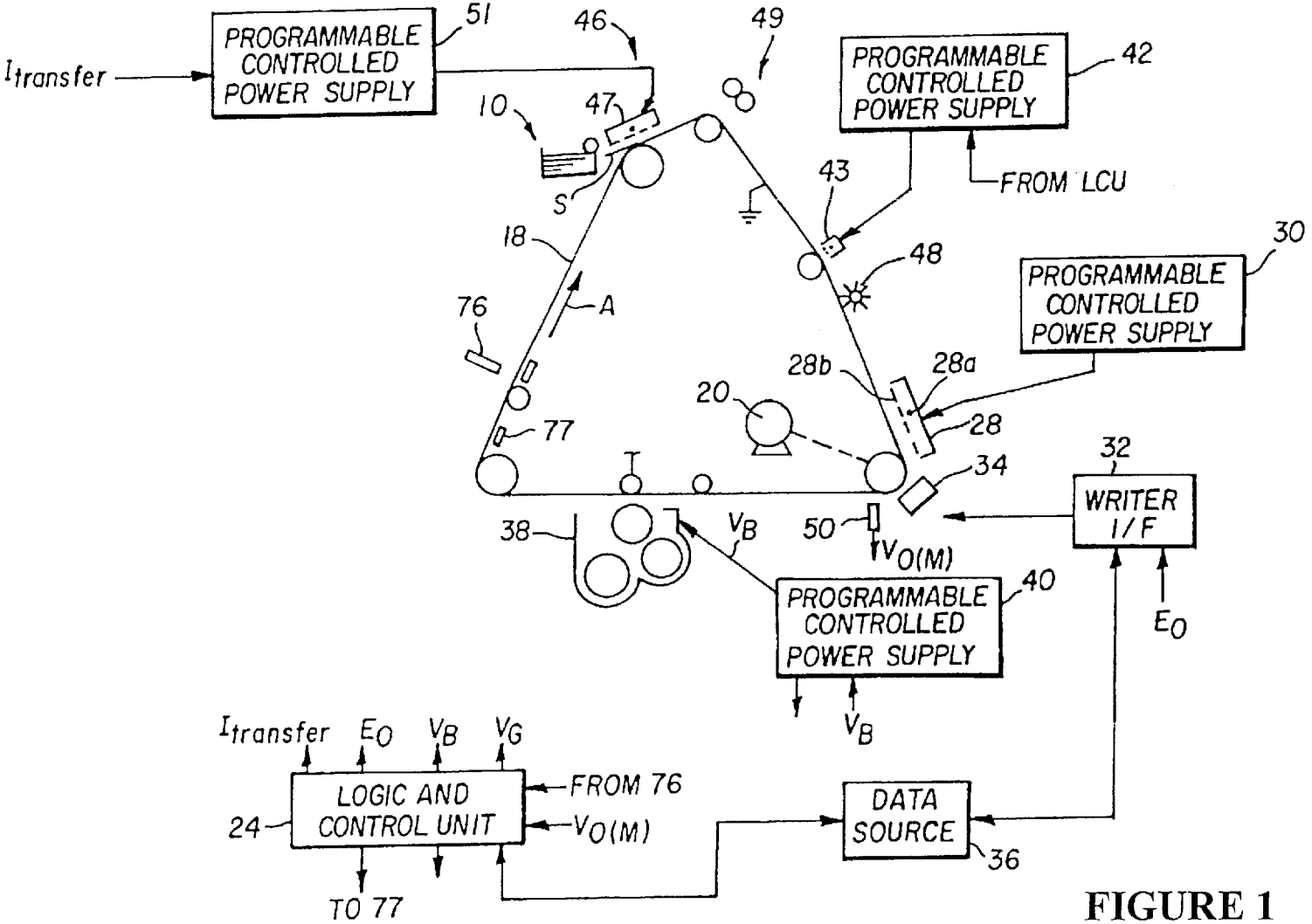
FIG. 1 is a side elevational view in schematic of an exemplary electrophotographic marking machine with which the present invention may be practiced.

Referring to FIG. 1, an electrophotographic marking machine 10 is shown. The present invention is described in the environment of a particular electrophotographic marking machine 10 such as a copier and/or a printer. However, it will be noted that although this invention is suitable for use with such machines, it also can be used with other types of electrophotographic copiers and printers.

Because electrophotographic marking machines of the general type described herein are well known the present description will be directed in particular to elements forming part of, or cooperating more directly with, the present invention.

To facilitate understanding of the foregoing, the following terms are defined:

$V_0$=Primary voltage (relative to ground) on the photoconductor as measured just after the primary charger.

$E_o$=the exposure control parameter affecting the light intensity of the exposure system. This is sometimes referred to as the "initial" voltage.

$V_{0(m)}$=the averaged (mean) value of individual $V_0$ values.

$V_B$=Development station electrode bias.

With reference to the electrophotographic marking machine 10 as shown in FIG. 1, a moving image recording member such as photoconductive belt 18 is trained about a plurality of rollers, one of which is driven by a motor to drive the belt past a series of work stations of the printer. The recording member may also be in the form of a drum. A logic and control unit (LCU) 24, which may include a digital computer, has a stored program for sequentially actuating the various work stations, or subsystems of the machine 10.

Briefly, a charging station sensitizes the belt 18 by applying a uniform electrostatic charge of predetermined primary voltage $V_0$ to the surface of the belt. The output of the primary charger 28 at the charging station is regulated by a programmable controlled power supply 30, which is in turn controlled by LCU 24 to adjust primary voltage $V_0$ for example through control of electrical potential ($V_{Grid}$) to a grid electrode 28*b* that controls movement of charged ions, created by operation of the charging electrode wires 28*a*, to the surface of the recording member as is well known. In this example the grid wires 28*b* are electrically biased negatively to, for example, between −350 and −750 volts and a nominal bias might be −500 volts.

At an exposure station, projected light from a write head 34 modulates the electrostatic charge on the photoconductive belt 18 to form a latent electrostatic image of a document to be copied or printed. The write head preferably has an array of light-emitting diodes (LEDs) or other light source such as a laser or other exposure source for exposing the photoconductive belt picture element (pixel) by picture element with an intensity regulated in accordance with signals from the LCU to a writer interface 32 that includes a programmable controller. Alternatively, the exposure may be by optical projection of an image of a document onto the photoconductor 18.

Where an LED or other electro-optical exposure source is used, image data for recording is provided by a data source 36 for generating electrical image signals such as a computer, a document scanner, a memory, a data network. Signals from the data source and/or LCU may also provide control signals to a writer network, etc.

Movement of belt 18 in the direction of the arrow A brings the areas bearing the latent electrostatographic charge images past a development station 38. That is, the belt is translated about a belt path as shown in FIG. 1. The toning or development station has one (more if color) or more magnetic brushes in juxtaposition to, but spaced from, the travel path of the belt. Magnetic brush development stations are well known. For example, see U.S. Pat. No. 4,473,029 to Fritz et al and U.S. Pat. No. 4,546,060 to Miskinis et al.

LCU 24 selectively activates the development station in relation to the passage of the image areas containing latent images to selectively bring the magnetic brush into engagement with or a small spacing from the belt 18. The charged toner particles of the engaged magnetic brush are attracted imagewise to the latent image pattern to develop the pattern which includes development of the patches used for process control.

As is well understood in the art, conductive portions of the development station, such as conductive applicator cylinders, act as electrodes. The electrodes are connected to a variable supply of D.C. potential $V_B$ regulated by a programmable controller 40. Details regarding the development station are provided as an example, but are not essential to the invention.

In this example development will be according to a DAD process wherein negatively charged toner particles selectively develop into relatively discharged areas of the photoconductor. Other types of development stations are well known and may be used.

A transfer station 46, as is also well known, is provided for moving a receiver sheet S into engagement with the photoconductor in register with the image for transferring the image to a receiver sheet such as plain paper or a plastic sheet. Alternatively, an intermediate member may have the image transferred to it and the image may then be transferred to the receiver sheet. In the embodiment of FIG. 1, the transfer station includes a transfer corona charger 47.

Electrostatic transfer of the toner image is effected with a proper voltage bias applied to the transfer charger 47 so as to generate a constant current as will be described below. The transfer charger in this example deposits a positive charge onto the back of the receiver sheet while the receiver sheet engages the toner image on the photoconductor to attract the toner image to the receiver sheet.

After transfer the receiver sheet may be detacked from the belt 18 using a detack corona charger (not shown) as is well known. A cleaning brush 48 or blade is also provided subsequent to the transfer station for removing toner from the belt 18 to allow reuse of the surface for forming additional images. To facilitate or condition remnant toner and other particles for removal by the brush 48 it is conventional to provide a charger device 43 to deposit, in this case, positive charge on the photoconductor to neutralize or reduce electrostatic adhesion of the remnant particles to the belt 18. The voltage to the cleaning-conditioning corona charger is controlled by a power supply 42. While separate power supplies are shown for each charger it will be appreciated that one supply having multiple taps may be used in lieu of plural charger supplies.

After transfer of the unfixed toner images to a receiver sheet, such sheet is transported to a fuser station 49 where the image is fixed.

A densitometer 76 is operably located intermediate the development station 38 and the transfer station 46. The densitometer 76 used to monitor development of areas of the photoconductive belt 18, as is well known in the art.

A second sensor that is also desirably provided for process control is an electrostatic voltmeter 50. Such a voltmeter is preferably provided after the primary charger 28 to provide readings of measured $V_0$ or $V_{0(m)}$. The voltmeter is preferably fixed relative to the belt 18, thereby reducing alignment and adjustments concerns associated with translatable voltmeter, particularly with respect to the belt 18. The voltmeter (electrometer) 18 can read both polarities of voltage and thus is used for determining all the voltage tests.

Outputs of $V_{0(m)}$ and density read by densitometer 76 are provided to the LCU 24 which in accordance with a process control program generates new set point values for $E_0$, $V_B$ and actuation of toner replenishment. Additionally, the process control may be used to adjust transfer current generated by the transfer charger 46 through adjustments to programmable power supply 51. A preferred electrometer is described in U.S. Pat. No. 5,956,544 in the names of Stem et al.

Thus, the machine 24 may be defined in terms of a plurality of subsystems, including, but not limited to the general descriptions of a charging system, an exposure station, a development subsystem, a transfer subsystem, a detacking subsystem, a fuser subsystem, wherein these subsystems include the previously described components such as the photoconductor, the primary charger, the bias offset, the detack charger and the transfer rollers.

The LCU 24 provides overall control of the apparatus and its various subsystems as is well known. Programming commercially available microprocessors is a conventional skill well understood in the art. The following disclosure is written to enable a programmer having ordinary skill in the art to produce an appropriate control program for such a microprocessor.

In lieu of only microprocessors, the logic operations described herein may be provided by or in combination with dedicated or programmable logic devices. In order to precisely control timing of various operating stations, it is well known to use encoders in conjunction with indicia on the photoconductor to timely provide signals indicative of image frame areas and their position relative to various stations. Other types of control for timing of operations may also be used.

Figure 2:
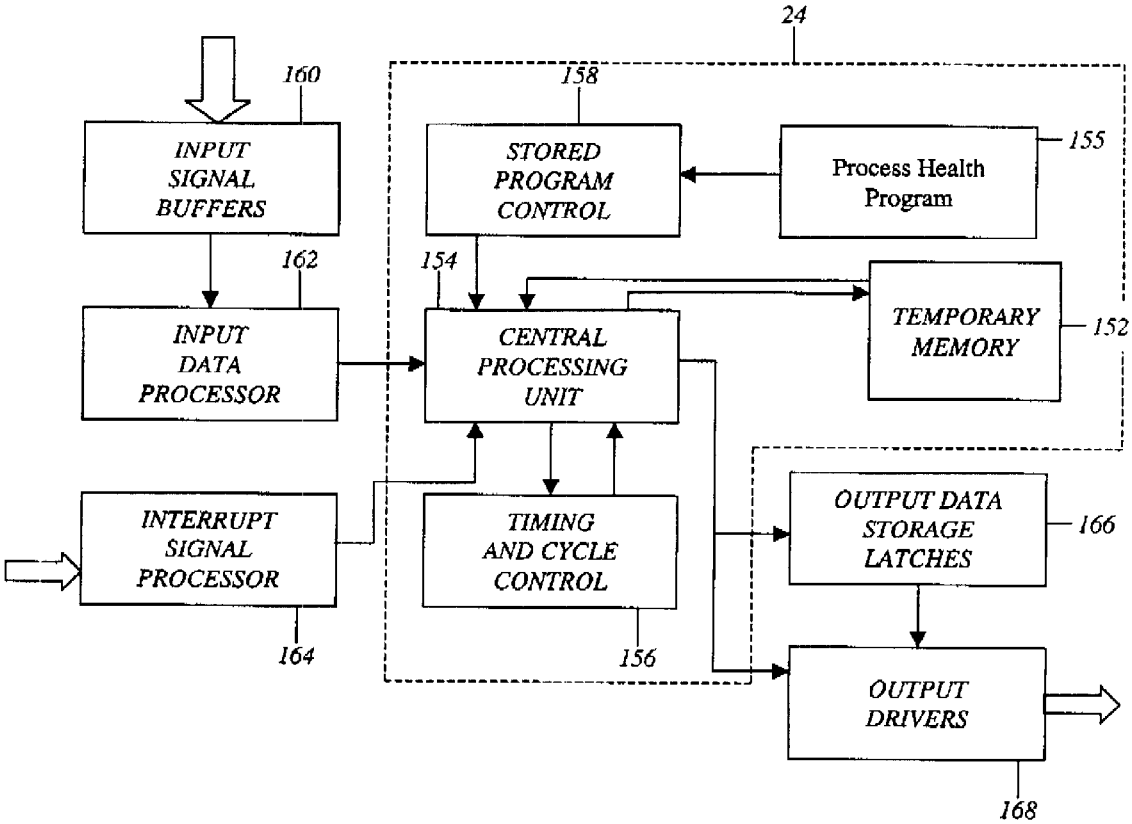
FIG. 2 is a block diagram of a logic and control unit shown in FIG. 1.

Referring to FIG. 2, a block diagram of a typical LCU 24 is shown. The typical LCU 24 includes temporary data storage memory 152, central processing unit 154, process and health module 155, timing and cycle control unit 156, and stored program control 158. Data input and output is performed sequentially through or under program control. Input data are applied either through input signal buffers 160 to an input data processor 162 or through an interrupt signal processor 164. The input signals are derived from various switches, sensors, and analog-to-digital converters that are part of the apparatus 10 or received from sources external to machine 10. The output data and control signals are applied directly or through storage latches 166 to suitable output drivers 168. The output drivers are connected to appropriate subsystems.

The LCU 24 is configured to conduct a number of tests on the subsystems. In performing the tests, the LCU provides a user operable print mode operation of the machine 10. In addition, the LCU 24 is configure to operate the machine 10 in test mode, wherein the complete photoelectric process is performed.

In the present test (non-print production) mode, the LCU 24 is generally configured to establish a predetermined voltage on the belt 18 and subsequently engage a particular subsystem, wherein the subsystem generates a corresponding variance in the belt voltage. The LCU 24 causes the belt 18 to rotate to the voltmeter 50, where in the resulting belt voltage is measured. The measured voltage is compared by the LCU 24 to a predetermined range of permissible values. In addition, if the measured voltage is outside the predetermined range, the amount of variance is provided to the field engineer.

The LCU 24 is further configured to isolate those subsystems not tested to reduce the potential of harming the particular subsystems.

Figure 3:
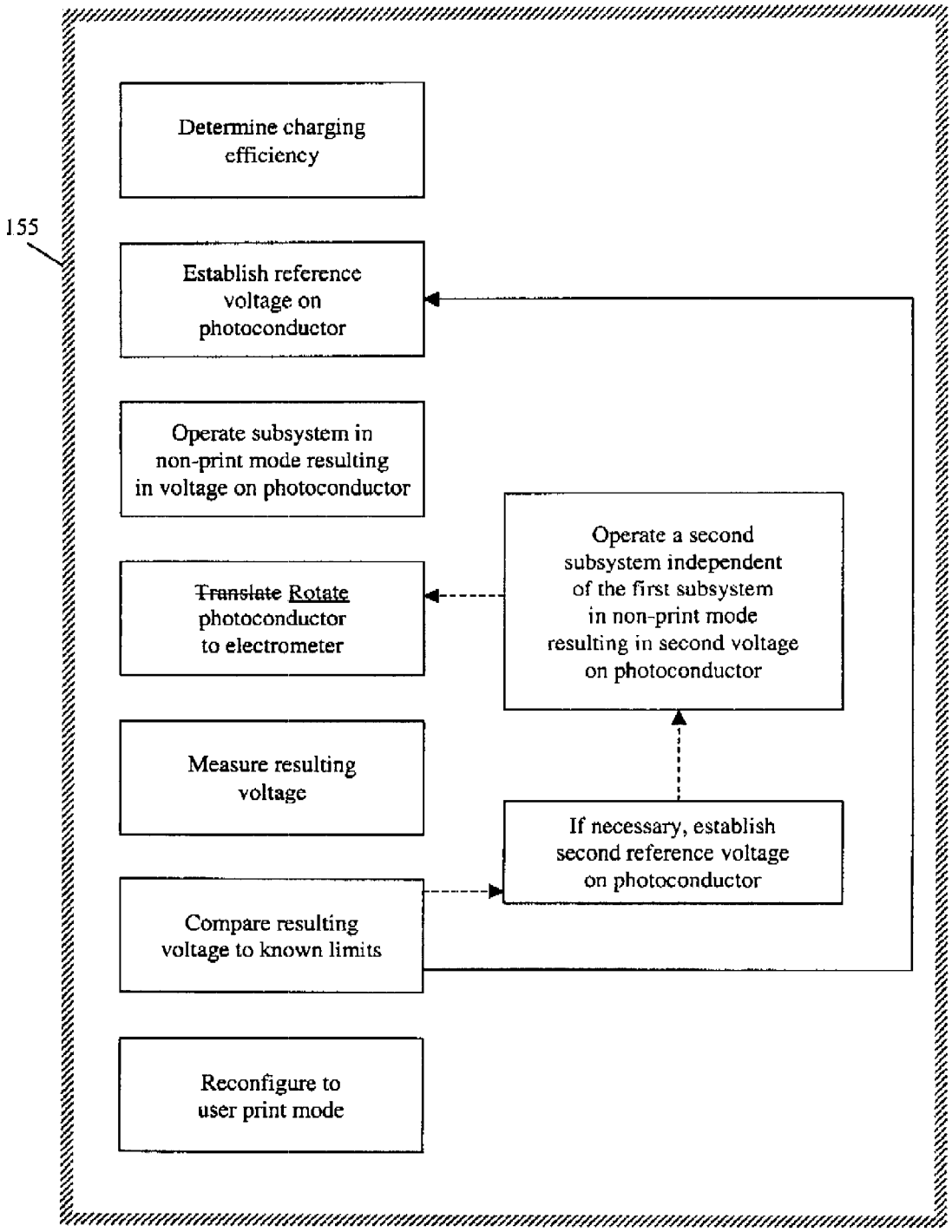
FIG. 3 is a flow chart of a portion of the operations performed by the logic and control unit.

The LCU also includes recovery or refresh procedures corresponding to each of the subsystem test procedures. The recovery procedures may be directly associated with a given subsystem test. The recovery procedures may return the machine 10 to the operable print mode. It is contemplated the recovery procedures may prepare the machine 10 for testing of additional subsystems. Referring to FIG. 3, a flow chart of the process and health program of the LCU 24 is shown.

More specifically, the LCU 24 measures a voltage of the primary charger and records a resulting voltage on the photoconductor as measured at the electrometer 50. The measured voltage of the photoconductor $V_{ofilm}$ is compared to the setpoint of the primary charger $V_{ogrid}$ to provide the charging efficiency defined as the ratio ($V_{ogrid}/V_{ofilm}$). It is well known in the art that contamination of the primary charging system (specifically the corona wire) by toner particle, paper fibers etc. decreases the charging efficiency as defined above. Thus, the initial test allows the field engineer to check the operability of the primary charger. The voltage of the photoconductor is compared to the measured voltage to provide a charging efficiency. As know in the art, an increase in charging efficiency is an indicator of increased contamination and dirt buildup in the primary charger. Thus, the initial test allows a field engineer to check the operability of the primary charger.

$$\left(\frac{V_{0grid}}{V_{0film}}\right)$$

Since the performance of some subsystems is evaluated by their effect on the photoconductor voltage, it is desirable to establish a film reference voltage $V_{0ref}$ on the photoconductor prior to the subsystem tests. The reference voltage is achieved by setting the grid voltage of the primary charger to $$V_{grid} = \left(\frac{V_{0grid}}{V_{0film}}\right) \cdot V_{0ref},$$

where $$\left(\frac{V_{0grid}}{V_{0film}}\right)$$

is the charging efficiency determined from values obtained in the primary charger test. The LCU thereby provides that each test is standardized to a known and fixed reference voltage.

The electrophotographic marking machine 10 is disposed in a non-print mode and the reference voltage $V_0$ is imparted to the belt 18. A particular sub assembly is then actuated, which creates or imparts a resulting voltage on the photo conductor belt 18. The LCU 24 then causes the belt 18 to be rotated along its path so that the resulting voltage on the belt is measured on the electrometer 50. That is, the LCU 24 causes the resulting voltage to be brought to the electrometer 50, rather than moving the electrometer to the resulting voltage.

The resulting voltage of the photoconductor 18 is then compared to a predetermined range of acceptable voltages to provide a Go-No Go criterion.

In addition, the operator is provided with a variance of the measured voltage resulting from the particular sub system so that a life expectancy can be provided.

Thus, the LCU 24 is provided with the following test procedures:

A. Main drive test—This test checks the master timing, splice detection and film tracking for the marking machine.

B. Auto set-up Phase I—Phase 1 auto set test checks the densiometer, photo conductor and then allows analysis of contamination.

C. Auto set-up Phase II—Phase 2 auto set-up checks the charging and electrometer calibration as well as bias offset.

D. Auto set-up Phase III—The Phase III auto set-up checks the process control and electrophotograph set points.

E. Auto set-up Phase IV—The Phase IV auto set-up checks the exposure level, and photo conductor toe-voltage.

F. Primary charger—The primary charger checks for contamination of the primary charger, and provides correspondence to the predetermined set points.

G. Pre-Clean charger—This test checks the film conditioning for cleaning after transfer, and before cleaning.

H. Detack charger—The detack charger program provides checking of the detack charger, as well as contamination and performance levels.

I. Transfer roller—The transfer roller test checks for the transfer charger and roller points.

J. Post-development erase—The post-development erase program checks the erase level voltage on the belt 18.

K. Internal scavenger—The internal scavenger is typically applied without providing a corresponding voltage as it is checking for false arcs on the internal scavenger.

L. External scavenger—The external scavenger tests also does not typically provide a resulting voltage as the testing for false and arcs in the external scavenger does not produce such voltages.

It also contemplated, each of the tests A–J may be conducted sequentially. Alternatively, the tests may be isolated for optimizing diagnosis of the machine 10.

In particular, subsystem tests G–J are evaluated by the on-board electrometer 50 mounted downstream in the exposure step. The machine sequencing is such that these charges are operated without the primary charger for just one photoconductor revolution to avoid damage to the photoelectric properties of the photoconductor. This procedure is provided by the LCU 24 timing which governs the process health routines. In the preferred embodiment, the tests G–J are preceded by test F, in order to measure the current charging efficiency.

Further, it is understood the subsystems may be activated and reactivated at specific spatial locations on the photoconductor loop. Further, the electrometer measurements may be synchronized so that data collected corresponds to the specific subsystem test.

The measurement revolution of the photo conductor is proceeded and succeeded by photo conductor revolutions of standard electrophotographic conditions, thus providing a recovery cycle.

The LCU 24 is configured to execute extensive self tests of the subsystems involved in the formation of the output image. The process health program of the LCU 24 ensures that the subsystems necessary for image formation (such as primary charger, bias offset, and exposure) are functional. In addition, the program checks to determine whether the subsystems that are not directly contributing to the image formation (such as detack charger, pre-clean charger, post development erase and scavenger bias) are within normal operating tolerances or conditions.

The data acquired in each subsystem test is compared to standard operating values and applicable error limits to derive a pass/fail or go-no go, status for each test. Thus, a field engineer can readily identify which subsystems are within acceptable limits, as well as determine the relative viability of the other subsystems.

The LCU 24 provides for disposing the electrophotographic marking machine 10 in a normal print production mode, wherein a user may employ the machine for its intended purpose of generating electrophotographically produced copies or prints. In addition, the LCU 24 configures the machine 10 in a non-print production configuration which is selectively controlled by the LCU to provide for a sub system analysis.

The invention has been described in detail with particular reference to certain preferred embodiments thereof, but it will be understood that variations and modifications can be effected within the spirit and scope of the invention.

What is claimed is:

1. A method of operating an electrophotographic marking machine having a plurality of subsystems, the method comprising the steps of:

a) disposing the marking machine in a non-print mode;

b) imparting a film reference voltage which is a function of charging efficiency to a photoconductor;

c) actuating one of the subsystems, thereby imparting a resulting voltage to the photoconductor;

d) measuring the resulting voltage; and, e) comparing the resulting voltage to a predetermined range of acceptable voltages.

2. A method in accordance with claim 1, wherein charging efficiency is a function of the ratio of primary charger voltage to photoconductor voltage.

3. A method in accordance with claim 1, wherein charging efficiency is a function of the ratio of primary charger voltage to photoconductor voltage measured during an initial test.

4. A method in accordance with claim 1, wherein step b) comprises setting a grid voltage of the primary charger.

5. A method in accordance with claim 1, wherein step d) comprises moving the photoconductor to a stationary sensor for the measuring.

6. A method in accordance with claim 1, further comprising the step of isolating subsystems not being tested.

7. A method of operating an electrophotographic marking machine having at least a rotating photoconductor, a primary charger subsystem, an exposure station subsystem, a development subsystem, a transfer subsystem, a detacking subsystem and a fuser subsystem, the method comprising the steps of:

a) disposing the marking machine in a non-print mode;

b) imparting a film reference voltage which is a function of charging efficiency to the photoconductor;

c) actuating one of the subsystems, thereby imparting a resulting voltage to the photoconductor;

d) measuring the resulting voltage; and, e) comparing the resulting voltage to a predetermined range of acceptable voltages.

8. A method in accordance with claim 7, wherein charging efficiency is a function of the ratio of primary charger voltage to photoconductor voltage.

9. A method in accordance with claim 7, wherein charging efficiency is a function of the ratio of primary charger voltage to photoconductor voltage measured during an initial test.

10. A method in accordance with claim 7, wherein step b) comprises setting a grid voltage of the primary charger.

11. A method in accordance with claim 7, wherein step d) comprises moving the photoconductor to a stationary sensor for the measuring.

12. An electrophotographic marking machine having a primary charger, a photoconductor and a plurality of subsystems, comprising:

(a) an electrometer at a fixed location; and (b) a logic and control unit configured to create a reference voltage which corresponds to a charging efficiency of the primary charger on the photoconductor; dispose the marking machine in a non-print mode; selectively actuate a subsystem to create a resulting voltage on the photoconductor; rotate the photoconductor to expose the resulting voltage to the electrometer, and measure the resulting voltage.

13. An electrophotographic marking machine in accordance with claim 12, wherein the charging efficiency is a function of the ratio of primary charger voltage to photoconductor voltage.

14. An electrophotographic marking machine in accordance with claim 12, wherein charging efficiency is a function of the ratio of primary charger voltage to photoconductor voltage measured during an initial test.

15. An electrophotographic marking machine in accordance with claim 12, wherein the logic and control unit is further configured to isolate subsystems not being tested.

16. A method of operating an electrophotographic marking machine having a plurality of subsystems including a primary charger having a grid electrode, the method comprising the steps of:

a) disposing the marking machine in a non-print mode;

b) imparting a film reference voltage $V_{0ref}$ to a photoconductor by setting grid electrode voltage according to $$V_{grid} = \left(\frac{V_{0grid}}{V_{0film}}\right) \cdot V_{0ref},$$

where $V_{grid}$ is the grid voltage, $V_{0grid}$ a grid voltage setting and $V_{0film}$ is a primary voltage on the photoconductor as measured just after the primary charger;

c) actuating one of the subsystems, thereby imparting a resulting second voltage to the photoconductor;

d) measuring the resulting voltage; and, e) comparing the resulting voltage to a predetermined range of acceptable voltages.

17. An electrophotographic marking machine having a primary charger having a grid electrode, a photoconductor and a plurality of subsystems, comprising:

(a) an electrometer at a fixed location; and (b) a logic and control unit configured to impart a film reference voltage $V_{0ref}$ on the photoconductor by setting grid electrode voltage according to $$V_{grid} = \left(\frac{V_{0grid}}{V_{0film}}\right) \cdot V_{0ref},$$

where $V_{grid}$ is the grid voltage, $V_{0grid}$ a grid voltage setting and $V_{0film}$ is a primary voltage on the photoconductor as measured just after the primary charger; dispose the marking machine in a non-print mode; selectively actuate a subsystem to create a resulting voltage on the photoconductor; rotate the photoconductor to expose the resulting voltage to the electrometer; measure the resulting voltage, and compare the resulting voltage to predetermined range.

* * * * *